US009841732B2

(12) United States Patent
Ito

(10) Patent No.: US 9,841,732 B2
(45) Date of Patent: Dec. 12, 2017

(54) WATCH EXTERNAL PART, MANUFACTURING METHOD FOR WATCH EXTERNAL PART, AND WATCH

(71) Applicant: SEIKO EPSON CORPORATION, Tokyo (JP)

(72) Inventor: Yoshifumi Ito, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 47 days.

(21) Appl. No.: 14/606,156

(22) Filed: Jan. 27, 2015

(65) Prior Publication Data

US 2015/0212493 A1 Jul. 30, 2015

(30) Foreign Application Priority Data

Jan. 30, 2014 (JP) ..... 2014-016244

(51) Int. Cl.

| | |
|---|---|
| ***G04B 37/22*** | (2006.01) |
| ***G04B 19/12*** | (2006.01) |
| ***G04B 39/00*** | (2006.01) |
| ***G04B 45/00*** | (2006.01) |
| ***G04B 19/04*** | (2006.01) |

(52) U.S. Cl.

CPC ..... *G04B 19/12* (2013.01); *G04B 19/042* (2013.01); *G04B 37/226* (2013.01); *G04B 39/006* (2013.01); *G04B 45/0076* (2013.01)

(58) Field of Classification Search

CPC ..... G04B 39/00

See application file for complete search history.

(56) References Cited

U.S. PATENT DOCUMENTS 4,252,862 A * 2/1981 Nishida ..... C23C 28/321 427/528
4,623,262 A * 11/1986 Gogniat ..... G04B 3/041 368/294
4,699,850 A * 10/1987 Kishi ..... C23C 28/00 428/469
4,725,511 A * 2/1988 Reber ..... A44C 27/00 29/896.32

(Continued)

FOREIGN PATENT DOCUMENTS

EP 1785785 A2 5/2007
EP 1918420 A2 5/2008

(Continued)

OTHER PUBLICATIONS

The Extended European Search Report for the corresponding European Application No. 15152827.0 dated Aug. 3, 2015.

*Primary Examiner* — Amy Cohen Johnson
*Assistant Examiner* — Jason Collins
(74) *Attorney, Agent, or Firm* — Global IP Counselors, LLP

(57) ABSTRACT

A watch external part of the present invention is equipped with a substrate and a coating formed using an aerosol deposition method. The coating is selectively provided at a portion of a site observable in a state with the watch external part incorporated in a watch. The substrate is made of a material including one type or two or more types selected from a group consisting of sapphire glass, quartz, and plastic. The watch external part is further equipped with a ground layer having at least one layer between the substrate and the coating.

9 Claims, 7 Drawing Sheets

(56) References Cited

U.S. PATENT DOCUMENTS

| | | | | |
|---|---|---|---|---|
| 4,745,035 | A * | 5/1988 | Saurer | A44C 27/006 428/614 |
| 4,791,017 | A * | 12/1988 | Hofmann | A44C 27/006 428/216 |
| 2009/0233123 | A1 | 9/2009 | Kawakami et al. | |
| 2010/0027383 | A1* | 2/2010 | Suzuki | C03C 17/3435 368/276 |
| 2011/0123815 | A1 | 5/2011 | Kawakami et al. | |
| 2011/0176396 | A1* | 7/2011 | Suzuki | C03C 17/3435 368/296 |
| 2013/0155822 | A1 | 6/2013 | Kawakami et al. | |
| 2015/0092524 | A1* | 4/2015 | Verdon | G04B 45/0076 368/285 |

FOREIGN PATENT DOCUMENTS

| | | | |
|---|---|---|---|
| JP | 55-081788 | U | 12/1978 |
| JP | 06-269931 | A | 9/1994 |
| JP | 2003-183848 | A | 7/2003 |
| JP | 2005-023365 | A | 1/2005 |
| JP | 2005-147942 | A | 6/2005 |
| JP | 2008-150660 | A | 7/2008 |
| JP | 2009-204577 | A | 9/2009 |
| JP | 2009-222604 | A | 10/2009 |
| JP | 2010-243164 | A | 10/2010 |
| JP | 2011-112462 | A | 6/2011 |
| JP | 2013-254892 | A | 12/2013 |

* cited by examiner

WATCH EXTERNAL PART, MANUFACTURING METHOD FOR WATCH EXTERNAL PART, AND WATCH

CROSS-REFERENCE TO RELATED APPLICATIONS

This application claims priority to Japanese Patent Application No. 2014-016244 filed on Jan. 30, 2014. The entire disclosure of Japanese Patent Application No. 2014-016244 is hereby incorporated herein by reference.

BACKGROUND

Technical Field

The present invention relates to a watch external part, a manufacturing method for a watch external part, and a watch.

Related Art

For watches, in addition to a demand for functions as a practical article, there is also a demand for excellent esthetics (aesthetic appearance) as a decorative item.

Because of this, for the watch external part, materials having an excellent texture such as various types of metal material or the like are used (see JP-A-2008-150660 (patent document 1), for example).

Then, to further improve the esthetics, providing of a decorative layer (coating) with a designated pattern is performed.

In the past, to provide a decorative layer (coating) with a designated pattern, a method was used such as performing vapor phase film deposition such as vacuum vapor deposition or the like in a state with a mask (resist or the like) arranged, and removing the unnecessary parts using etching after film formation was performed on the entire surface of the substrate.

However, with these methods, the constitutional materials of the coating included in the final watch external part are only a tiny portion of the materials used for manufacturing, so there was a great deal of wasted material, and this was not desirable from the perspective of saving resources.

Also, recovery of the coating forming materials, recycling of the recovered material, and an increase in the steps accompanying use of resist or the like and use of chemical substances caused problems including being a burden on the environment and increasing costs.

SUMMARY

One aspect of the present invention is to provide a watch external part with excellent aesthetic appearance, little waste of materials during manufacturing, and a small burden on the environment, to provide a manufacturing method for a watch external part that, with a method with little wasted materials and a small burden on the environment, is able to efficiently manufacture the watch external part with excellent aesthetic appearance, and to provide a watch equipped with a watch external part with excellent aesthetic appearance, little waste of materials during manufacturing, and a small burden on the environment.

This kind of aspect is achieved using the present invention noted below.

The watch external part of the present invention is equipped with a substrate, and a coating formed using an aerosol deposition method.

By doing this, it is possible to provide a watch external part with excellent aesthetic appearance, little waste of materials during manufacturing, and a small burden on the environment.

With the watch external part of the present invention, it is preferable that the coating be selectively provided at a portion of a site observable in a state with the watch external part incorporated in a watch.

By doing this, it is possible to have particularly excellent aesthetic appearance for the watch external part and the watch.

With the watch external part of the present invention, it is preferable that the substrate be transparent.

By doing this, for example, it is possible to have particularly excellent aesthetic appearance for the watch external part. Also, for example, with a watch equipped with a watch external part, even in a case when the surface on the side facing opposite the surface on which the coating of the watch external part is provided is arranged so as to face the outside surface side, the user or the like can visually recognize the coating well, and it is possible to more reliably prohibit damage due to friction or the like of the coating or the like while effectively exhibiting the effect of being equipped with the coating, and possible to have that watch have particularly excellent durability.

With the watch external part of the present invention, it is preferable that the substrate be made of a material including one type or two or more types selected from a group consisting of sapphire glass, quartz, and plastic.

Because of that, it is possible to have the aesthetic appearance of the watch external part be even more excellent. Also, it is possible to have the durability of the watch equipped with the watch external part be even more excellent.

The watch external part of the present invention is further equipped with a ground layer having at least one layer between the substrate and the coating.

By doing this, for example, it is possible for the adhesion between the substrate and the coating to be particularly excellent. Also, for example, by having the ground layer function as a colored layer, it is also possible to further improve the aesthetic appearance of the watch external part. Also, by having the ground layer function as a gap layer, it is possible to obtain an external appearance with a three-dimensional feeling such as that the coating is raised up.

With the watch external part of the present invention, it is preferable that the ground layer be a layer made of TiN.

By doing this, it is possible to have an item with particularly excellent adhesion between the substrate and the coating, and particularly the adhesion when the coating is constituted by a metal material or a metal oxide or metal nitride.

With the watch external part of the present invention, it is preferable that the coating be made of a metal material.

By doing this, it is possible to more suitably perform film formation using the aerosol deposition method, and possible to have an item with particularly excellent aesthetic appearance of the watch external part. Also, it is also possible to have an item with particularly excellent adhesion between the substrate and the coating, and possible to have an item with particularly excellent durability of the watch external part.

With the watch external part of the present invention, it is preferable that the coating be made of a metal oxide and/or a metal nitride.

By doing this, it is possible to more suitably perform film formation using the aerosol deposition method, and possible to have an item with particularly excellent aesthetic appearance of the watch external part. Also, it is possible to have an item with particularly excellent coating hardness, and possible to have an item with particularly excellent durability of the watch external part.

The watch external part of the present invention is further equipped with an antireflective coating disposed on a surface side opposite to a surface of the coating facing the substrate.

By doing this, it is possible to effectively prevent unintentional glare of external light, and possible to have an item with particularly excellent aesthetic appearance of the watch external part. Also, in a case when the watch external part are used for a cover glass (windshield glass), it is possible to obtain the effect of improving the aesthetic appearance as noted above, to improve the visibility of the dial, and also possible to have an item with particularly excellent aesthetic appearance as an overall watch. Also, functions as a practical item are improved, such as the ability to identify the time and the like.

A manufacturing method for a watch external part of the present invention includes preparing a substrate, and forming a coating using an aerosol deposition method.

By doing this, it is possible to provide a manufacturing method for a watch external part that, with a method with little wasted materials and a small burden on the environment, is able to efficiently manufacture the watch external part with excellent aesthetic appearance.

The manufacturing method for a watch external part of the present invention preferably includes forming a ground layer having at least one layer between the preparing of the substrate and the forming of the coating.

By doing this, for example, it is possible to have an item with particularly excellent adhesion between the substrate and the coating. Also, for example, by having the ground layer function as a colored layer, it is also possible to further improve the aesthetic appearance of the watch external part. Also, by having the ground layer function as a gap layer, it is possible to obtain an external appearance with a three-dimensional feeling such as with the coating raised up.

The manufacturing method for a watch external part of the present invention preferably includes forming an antireflective coating after the forming of the coating.

By doing this, it is possible to effectively prevent unintentional glare of outside light, and possible to have an item with particularly excellent aesthetic appearance of the watch external part. Also, in a case when the watch external part are used for a cover glass (windshield glass), it is possible to obtain the effect of improving the aesthetic appearance as noted above, and to improve the visibility of the dial, and also possible to have an item with particularly excellent aesthetic appearance as an overall watch. Also, functions as a practical item are improved, such as the ability to identify the time and the like.

A watch of the present invention is equipped with the watch external part of the present invention.

By doing this, it is possible to provide a watch equipped with a watch external part with excellent aesthetic appearance, little waste of materials during manufacturing, and a small burden on the environment.

A watch of the present invention is equipped with the watch external part manufactured using the manufacturing method of the present invention.

By doing this, it is possible to provide a watch equipped with a watch external part with excellent aesthetic appearance, little waste of materials during manufacturing, and a small burden on the environment.

BRIEF DESCRIPTION OF THE DRAWINGS

Referring now to the attached drawings which form a part of this original disclosure:

FIG. 5 is a vertical cross section side view showing an example of the constitution of the crushing device the coating forming device is equipped with;

DETAILED DESCRIPTION OF EMBODIMENTS

Following, we will give a detailed description of the watch external part, the manufacturing method of a watch external part, and the watch of the present invention based on preferred embodiments shown in the attached drawings.

Watch External Part

First, we will describe the watch external part of the present invention.

With the present invention, the watch external part are constitutional parts of the watch, and mean parts that are visible from the outside when using the watch, and in addition to items that are used when the watch exterior is exposed, include the concept of parts housed on the interior of the watch.

As a watch external part, examples include a cover glass (windshield glass), a dial, hands (hour hand, minute hand, second hand, and the like), a bezel, a case, a back cover, a winding knob, rotating displays such as a round disk hand, day indicator, month indicator, moon phase disk and the like.

Figure 1:
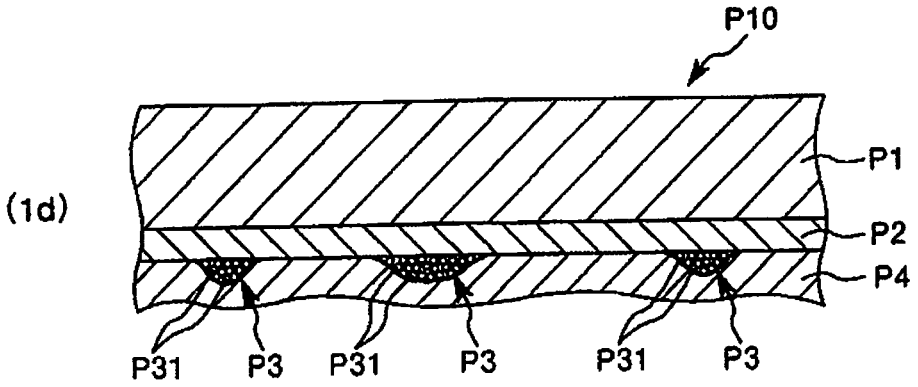
FIG. 1 is a schematic cross section diagram showing a preferred embodiment of the watch external part of the present invention.
Figure 2:
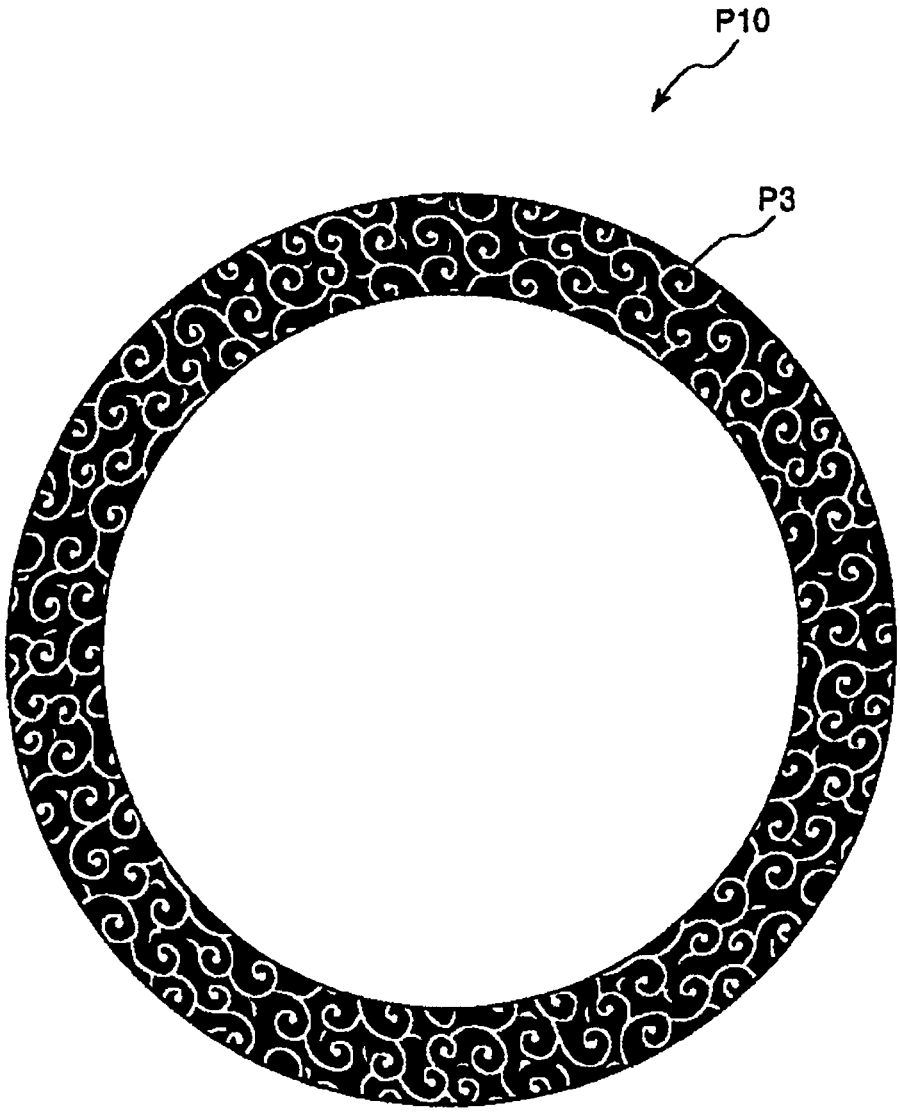
FIG. 2 is a schematic plan view showing a preferred embodiment when the watch external part of the present invention are used for a cover glass.

FIG. 1 is a schematic cross section view showing a preferred embodiment of the watch external part of the present invention, and FIG. 2 is a schematic plan view showing a preferred embodiment when applying the watch external part of the present invention to a cover glass.

As shown in FIG. 1, a watch external part P10 is equipped with a substrate P1, a ground layer P2, a coating P3, and an antireflective coating P4.

Substrate

The substrate P1 can be constituted using any material, but preferably is an item with transparency.

By doing this, for example, it is possible to have an item with particularly excellent aesthetic appearance of the watch external part P10. Also, for example, with a watch equipped with the watch external part P10, even in a case when the arranged so that the surface of the side opposite to the surface on which the coating P3 is provided faces the outer surface side, it is possible for the user to suitably visually recognize the coating P3, and while effectively exhibiting the effect of being equipped with the coating P3, to more reliably prevent damage due to friction or the like with the coating P3 or the like, and possible to have an item with particularly excellent durability for that watch. With this specification, the "aesthetic appearance of the watch external part P10", in addition to the aesthetic appearance when the watch external part P10 are viewed individually, also includes the concerned site in a state with the watch external part P10 incorporated in the watch.

The transmittance of the light of the substrate P1 (transmittance of light of wavelength 600 nm) is not particularly limited, but is preferably 85% or greater, and more preferably 90% or greater.

Examples of preferred constitutional materials of the substrate P1 include sapphire glass, quartz, plastic and the like.

When the substrate P1 is constituted with materials including one type or two or more types selected from this group, it is possible to have an item with even more excellent aesthetic appearance of the watch external part P10. Also, it is possible to have an even more excellent item in terms of durability of the watch equipped with the watch external part P10.

The substrate P1 can have a uniform composition at each site, or can have different compositions. For example, it can be a laminated body for which layers of different compositions are layered in the thickness direction, or can be constituted with a gradient material for which the composition changes incrementally.

Coating

The coating P3 is formed using the aerosol deposition method.

With the present invention, the aerosol deposition method means a method by which an aerosol, made by dispersing in gas separately prepared fine particles (fine particles of the material that will become the coating), is sprayed from a nozzle toward the substrate, and by that impact force, the coating is formed on the substrate. With the aerosol deposition method, as described in detail later, there are the features of it being possible to form the coating P3 selectively on desired sites, and it being possible to effectively prevent the occurrence of wasting of materials. It is also possible to omit or simplify front end processing such as mask formation or the like, and back end processing such as removing unnecessary film formation parts or the like. It is also possible to form the coating P3 constituted by materials having an excellent texture.

In this way, by the coating P3 being an item formed using the aerosol deposition method, it is possible to provide the watch external part P10 with excellent aesthetic appearance, little waste of materials during manufacturing, and a small burden on the environment.

Also, with the aerosol deposition method, it is not necessary to use volatile solvents or the like, so in a state with the watch external part P10 incorporated in a watch, it is possible to effectively prevent the occurrence of problems (movement failure, the occurrence of trouble, clouding or the like of the cover glass or the like) due to volatilization of the volatile components (volatile organic compounds).

The coating P3 can be an item constituted with any material, but constituted using a metal material, the following kinds of effects can be obtained.

Specifically, when the coating P3 is constituted using a metal material, it is possible to more suitably perform film formation using the aerosol deposition method, and possible to have an item that is particularly excellent in terms of the aesthetic appearance of the watch external part P10. It is also possible to have an item that is particularly excellent in terms of the adhesion between the substrate P1 and the coating P3 (in particular, the adhesion via the ground layer P2), and possible to have an item excellent in terms of the durability of the watch external part P10.

As the metal material constituting the coating P3, examples include Au, Pt, Pd, Ni, Ag Al, Cu, Ti, Cr, or alloys including at least one of these or the like, but it is preferable to include Au.

By doing this, it is possible to have an item that is even more excellent in terms of aesthetic appearance for the watch external part P10. Also, Au is an expensive precious metal, and is especially high in terms of burden on the environment by substances used to recover items that were not used in film formation. Therefore, when the coating P3 is a metal material containing Au, there is more marked exhibiting of the effects due to using the present invention.

Also, when the coating P3 is constituted with a metal oxide and/or a metal nitride, the following kinds of effects can be obtained.

Specifically, when the coating P3 is constituted with a metal oxide and/or a metal nitride, it is possible to more suitably perform film formation using the aerosol deposition method, and possible to have an item that is particularly excellent in terms of aesthetic appearance for the watch external part P10. It is also possible to have an item that is particularly excellent in terms of hardness for the coating P3, and possible to have an item that is particularly excellent in terms of durability for the watch external part P10.

As the metal oxide constituting the coating P3, examples include aluminum oxide, titanium oxide, chrome oxide, silicon oxide or the like.

As the metal nitride constituting the coating P3, examples include titanium nitride, chrome nitride, zirconium nitride, hafnium nitride, tantalum nitride, silicon nitride or the like.

The constitutional material of the coating P3 is not limited to the kinds of items noted above, and for example, it is possible to use various types of materials such as carbon materials, metal carbides, metal borides, pigments and the like.

As a coloring agent, it is possible to use publicly known items, for example.

In specific terms, as a black pigment, examples include carbon blacks such as furnace black, channel black, acetylene black, thermal black or the like, copper oxide, manganese dioxide, titanium oxide, aniline black, activated carbon, nonmagnetic ferrite, magnetite or the like. Also, as a yellow pigment, examples include chrome yellow, zinc yellow, yellow iron oxide, cadmium yellow, chrome yellow, Hansa yellow, Hansa yellow 10G, benzidine yellow G, benzidine yellow GR, threne yellow, quinoline yellow, permanent yellow NCG and the like.

Also, as orange pigments, examples include red chrome yellow, molybdenum orange, permanent orange GTR, pyrazolone orange, Vulcan orange, benzidine orange G, indanthrene brilliant orange RK, indanthrene brilliant orange GK and the like. As red pigment, examples include iron oxide red, cadmium red, minium, mercury sulfide, watching red, permanent red 4R, lithol red, brilliant carmine 3B, brilliant carmine 6B, Dupont oil red, pyrazolone red, Rhodamine B Lake, lake red C, rose bengal, eosin red, alizarin lake and the like.

As blue pigment, examples include Prussian blue, cobalt blue, alkali blue lake, Victoria blue lake, fast sky blue, indathrene blue BC, aniline blue, ultramarine blue, calco oil blue, methylene blue chloride, phthalocyanine blue, phthalocyanine green, malachite green oxalate and the like. As purple pigment, examples include manganese violet, fast violet B, methyl violet lake and the like.

As green pigment, examples include chrome oxide, chrome green, pigment green, malachite green lake, final yellow green G and the like. As white pigment, examples include zinc oxide, titanium oxide, antimony white, zinc sulfide and the like. As fillers, examples include baryta powder, barium carbonate, clay, silica, white carbon, talc, alumina white and the like. Furthermore, as dyes, examples include various types of dyes such as basic, acidic, disperse, direct dyes and the like, including examples such as nigrosine, methylene blue, rose bengal, quinoline yellow, ultramarine blue and the like.

The coating P3 is formed by sedimentation of a plurality of particles P31.

The average primary particle diameter of the particles constituting the coating P3 (primary particle average particle diameter) is preferably 150 μm or less.

By doing this, it is possible to have an item particularly excellent in terms of aesthetic appearance for the watch external part P10. It is also possible to have an item that is particularly excellent in terms of adhesion between the substrate P1 and the coating P3 (particularly the adhesion via the ground layer P2), and possible to have an item that is particularly excellent in terms of durability of the watch external part P10.

The average primary particle diameter (average diameter of the primary particles) of the particles constituting the coating P3 is preferably 150 μm or less, and is more preferably 150 nm or greater and 100 μm or less.

With this specification, the "average particle diameter" indicates the mass standard average particle diameter. This average particle diameter can be obtained by measuring the mobility of aerosol, and finding the aerodynamic diameter, for example. Measuring the particle diameter can be done using nanoDMA-SMPS made by TSI Corp., or the like, for example. The average particle diameter can also be found from the measurement results of a scanning electron microscope or transmission electron microscope.

The coating P3 is preferably selectively provided at a portion of a site that can be observed in a state with the watch external part P10 incorporated in the watch.

By doing this, it is possible to have particularly excellent aesthetic appearance for the watch external part P10 and the watch by the effect of the coating P3 itself having a special pattern, or the effect by combining sites where the coating P3 is provided and sites where the coating P3 is not provided.

Also, in the past, in a state with the watch external part incorporated in the watch, when the coating is selectively provided on a portion of the site that can be observed, there were problems such as that waste of material during manufacturing of the watch external part was especially high, but with the present invention, it is possible to reliably prevent the occurrence of this kind of problem. Therefore, when the coating P3 is selectively provided in a portion of the site that can be observed in a state with the watch external part P10 incorporated in the watch, there is more marked exhibition of the effects of the present invention.

In a state with the watch external part P10 incorporated in the watch, of the sites that can be observed of the watch external part P10, the surface area rate occupied by the site on which the coating P3 is provided (when the surface of the watch external part P10 is flat, the surface area rate when observed from the normal line direction of that surface) is not particularly limited, but it is preferably 70% or less, and more preferably 2% or greater and 50% or less.

By doing this, the effects like those described previously are more markedly exhibited.

The average thickness of the coating P3 is preferably 0.15 μm or greater and 100 μm or less.

By doing this, it is possible to have an item that is particularly excellent in terms of aesthetic appearance for the watch external part P10. It is also possible to have an item that is particularly excellent in terms of durability of the watch external part P10.

In a state incorporated in the watch, the watch external part P10 is preferably arranged so that the surface on which the coating P3 is provided becomes the inner surface side. By doing this, it is possible to more effectively prevent unintentional peeling or the like of the coating P3, and possible to have an item that is particularly excellent in terms of durability for the watch.

The coating P3 that the watch external part P10 is equipped with can have a uniform composition at each site, or can have different compositions. For example, the watch external part P10 can be an item for which the plurality of types of coating P3 of different textures (e.g., different colors) have a designated pattern. By doing this, it is possible to further increase the aesthetic appearance of the watch external part P10.

Ground Layer

With the constitution in the drawings, the ground layer P2 is provided between the substrate P1 and the coating P3.

By doing this, for example it is possible to have an item that is particularly excellent in terms of adhesion between the substrate P1 and the coating P3 (adhesion via the ground layer P2). Also, for example, by having the ground layer P2 function as a colored layer, it is possible to further improve the aesthetic appearance of the watch external part P10. Also, by having the ground layer P2 function as a gap layer, it is possible to obtain an external appearance with a three-dimensional feeling such as with the coating P3 raised up.

The average thickness of the ground layer P2 is preferably 0.01 μm or greater and 10 μm or less.

By doing this, the ground layer P2 is able to more effectively exhibit the kinds of functions described previously.

The ground layer P2 can be constituted using any kind of material, but it is preferably constituted using TiN.

By doing this, it is possible to have an item with excellent adhesion between the substrate P1 and the coating P3 (adhesion via the ground layer P2), and particularly the adhesion when the coating P3 is constituted using a metal material or a metal oxide or metal nitride. Also, TiN is a material that has high transparency at a thickness like that described previously, so it is possible to more effectively prevent having an adverse effect on the external appearance overall as the watch external part P10.

With the constitution in the drawing, the ground layer P2 is provided on the entire surface of the side on which the coating P3 is provided of the substrate P1, but for example, it is also possible to have the ground layer P2 selectively provided only on the sites in contact with the coating P3. Also, the ground layer P2 can be provided only on a portion of the site on which the coating P3 is provided.

Also, with the constitution in the drawing, we described a case when equipped with one layer of the ground layer P2, but it is also possible for the watch external part to be equipped with two or more layers of the ground layer.

The ground layer P2 can have a uniform composition at each site, or can have different compositions. For example, it can be constituted with a laminated body for which different compositions are layered in the thickness direction, or with a gradation material for which the composition changes incrementally.

Antireflective Coating

With the constitution in the drawing, the antireflective coating P4 is provided on the surface side opposite to the surface of the coating P3 facing the substrate P1.

By doing this, it is possible to effectively prevent unintentional glare of external light, and possible to have an item that is particularly excellent in terms of aesthetic appearance for the watch external part P10.

Also, in a case when the watch external part P10 is used for cover glass (windshield glass), the effect of improving the aesthetic appearance as noted above is obtained, and it is possible to improve the visibility of the dial, and possible to have an item that is particularly excellent in terms of aesthetic appearance as the overall watch. It is also possible to improve the functions as a practical item, such as by improving the ability to identify the time and the like.

The thickness of the antireflective coating P4 is not particularly restricted, but it is preferably 0.2 μm or greater and 10 μm or less, and more preferably 0.3 μm or greater and 7 μm or less.

By doing this, while effectively preventing a larger size and increased thickness of the watch external part P10, it is possible to more effectively exhibit functions such as those described previously.

With the constitution in the drawing, the antireflective coating P4 is provided on the entire surface on the side of the substrate P1 on which the coating P3 is provided, but for example it is also possible to have the antireflective coating P4 provided selectively only on a portion of the surface of the side of the substrate P1 on which the coating P3 is provided.

Next, we will describe a specific example of when the watch external part of the present invention is used for a cover glass (windshield glass).

As shown in FIG. 2, the watch external part P10 of this embodiment as the cover glass has the coating provided selectively near the outer circumference part when seen with a plan view.

In particular, with the constitution in the drawing, the coating is provided with a designated pattern (arabesque design). In this way, even with a coating P3 with a complex pattern, with the present invention, it is possible to obtain an item with little material waste during manufacturing, and a small burden on the environment.

Manufacturing Method of Watch External Part

Next, we will describe the manufacturing method of the watch external part of the present invention.

Figure 3:
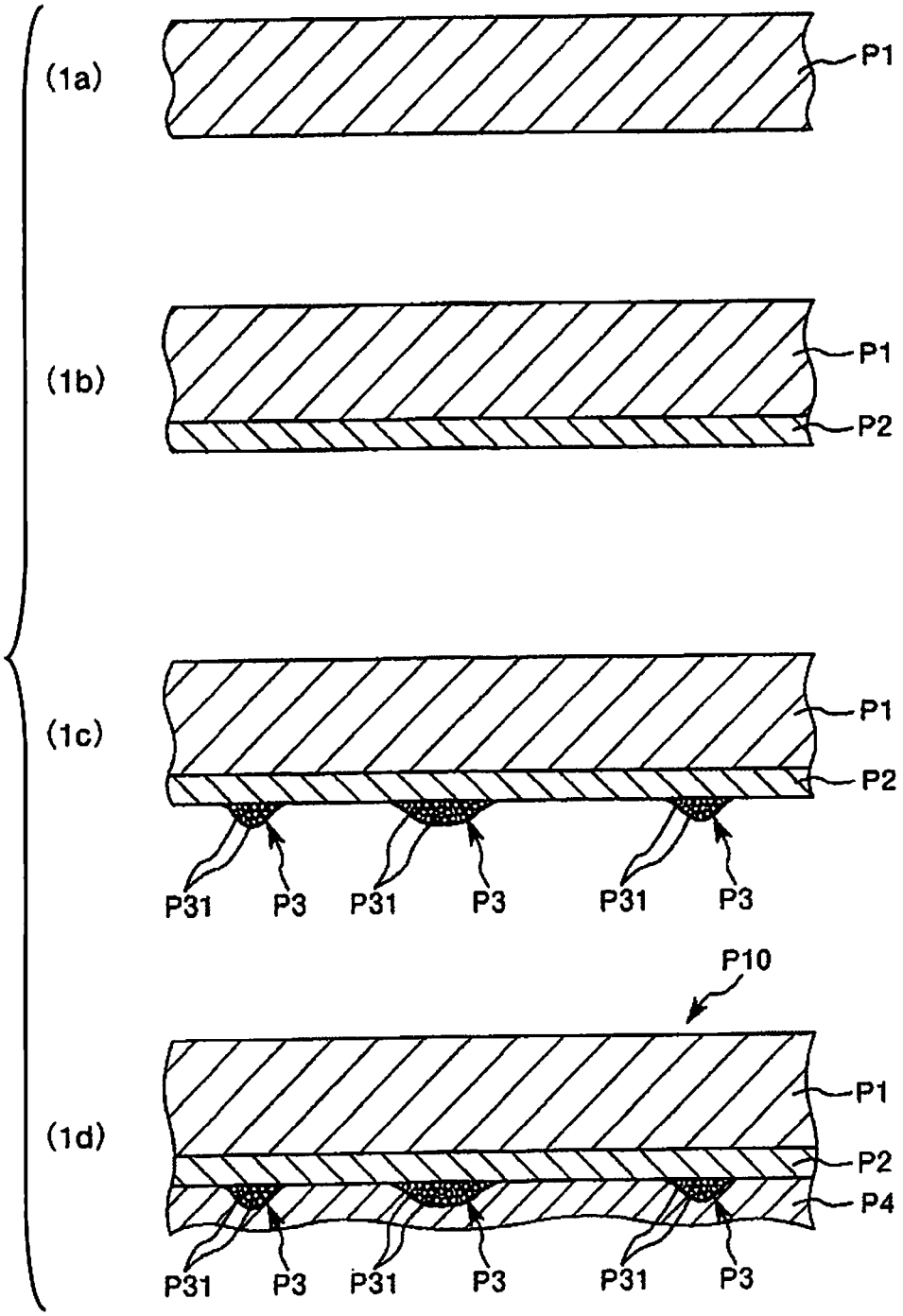
FIG. 3 is a cross section view schematically showing each step for a preferred embodiment of the manufacturing method of the watch external part of the present invention.

FIG. 3 is a cross section view schematically showing each step for a preferred embodiment of the manufacturing method of the watch external part of the present invention.

As shown in FIG. 3, the manufacturing method of this embodiment has a substrate preparing step (1*a*) for preparing the substrate P1, a ground layer forming step (1*b*) for forming the ground layer P2 on the surface of the substrate P1, a coating forming step (1*c*) for forming the coating P3 using the aerosol deposition method on the surface of the ground layer P2, and an antireflective coating forming step (1*d*) for forming the antireflective coating P4 on the surface side of the substrate P1 on which the ground layer P2 and the coating P3 are provided.

Substrate Preparation Step

With the substrate preparation step, the substrate P1 like that described previously is prepared (1*a*).

The substrate P1 prepared with this step can also undergo a cleaning process such as a water rinse, alkaline cleaning, acid cleaning, a rinse using an organic solvent or the like.

It is also possible to implement surface processing with the goal of improving adhesion with the layer formed on the substrate P1 or the like.

Ground Layer Forming Step

Next, the ground layer P2 is formed on the surface of the substrate P1 (1*b*).

As the ground layer P2 formed with this step, it is preferable that the kinds of conditions described previously be fulfilled.

The ground layer P2 can be formed, for example, using a vapor phase film deposition method (dry plating method) such as vacuum vapor deposition, ion plating, sputtering, chemical vapor deposition (CVD) or the like, a wet plating method, dipping or the like.

Coating Forming Step

Next, the coating P3 is formed on a portion of the surface of the ground layer P2 using the aerosol deposition method (1*c*).

As the coating P3 formed with this step, it is preferable that the kinds of conditions described previously are fulfilled.

For the coating forming device used with this step, we will give a detailed description later.

Antireflective Coating Forming Step

Next, the antireflective coating P4 is formed on the surface side of the substrate P1 on which the ground layer P2 and the coating P3 are provided (1*d*).

As the antireflective coating P4 formed with this step, it is preferable that the kinds of conditions described previously are fulfilled.

The antireflective coating P4 can be formed, for example, using a vapor phase film deposition method (dry plating method) such as vacuum vapor deposition, ion plating, sputtering, chemical vapor deposition (CVD) or the like, a wet plating method, dipping or the like.

Coating Forming Device

Next, we will describe the coating forming device used for forming the coating P3.

Figure 4:
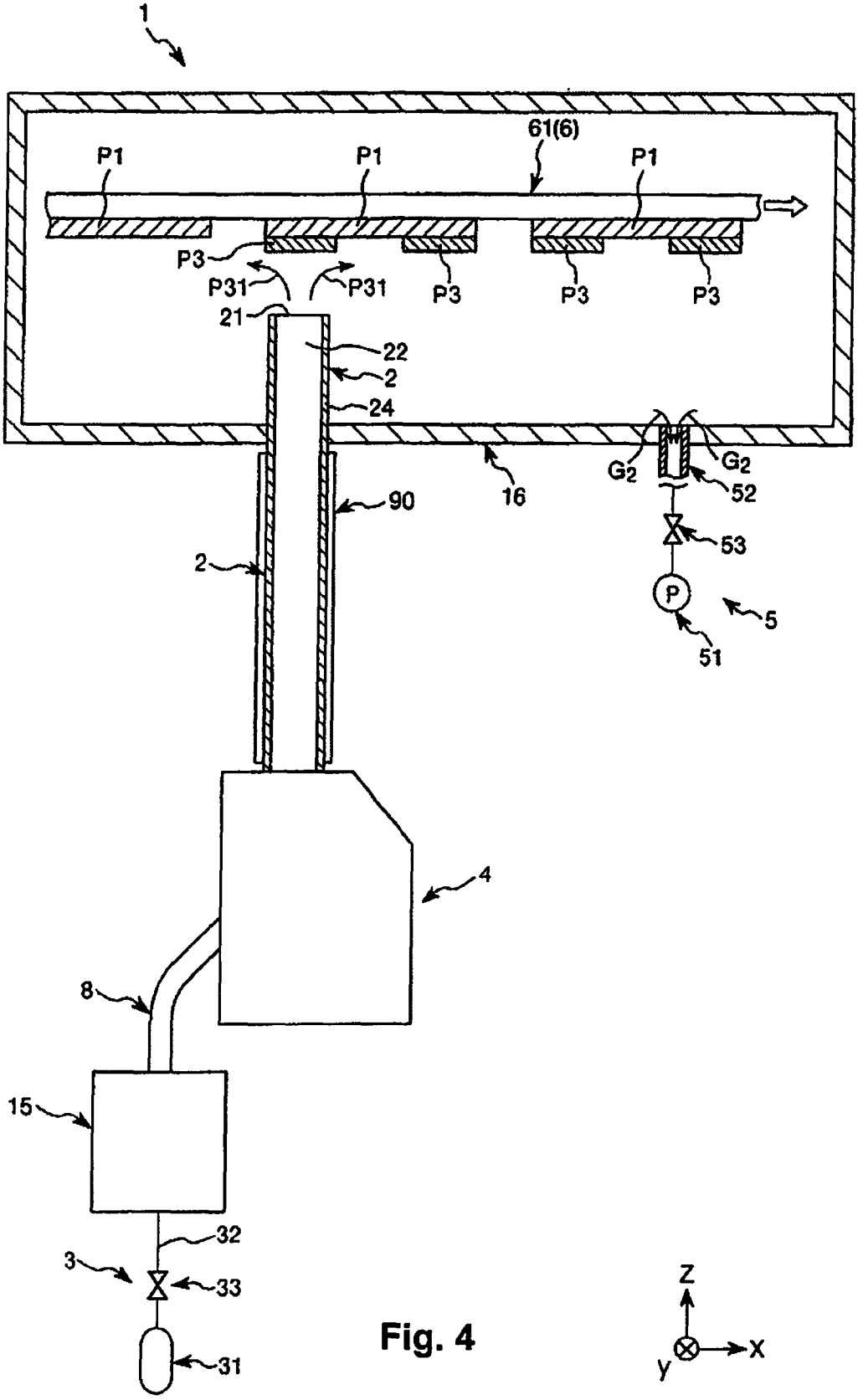
FIG. 4 is a vertical cross section side view showing a preferred embodiment of the coating forming device used to form the coating.
Figure 5:
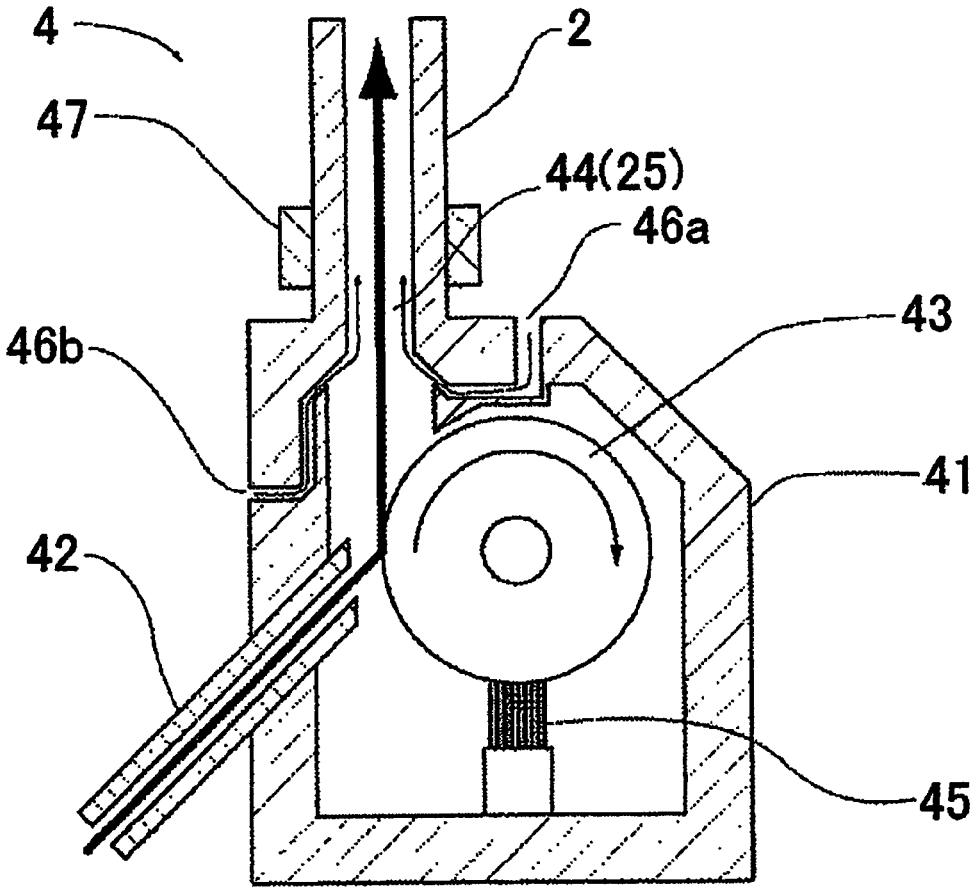
Figure 6:
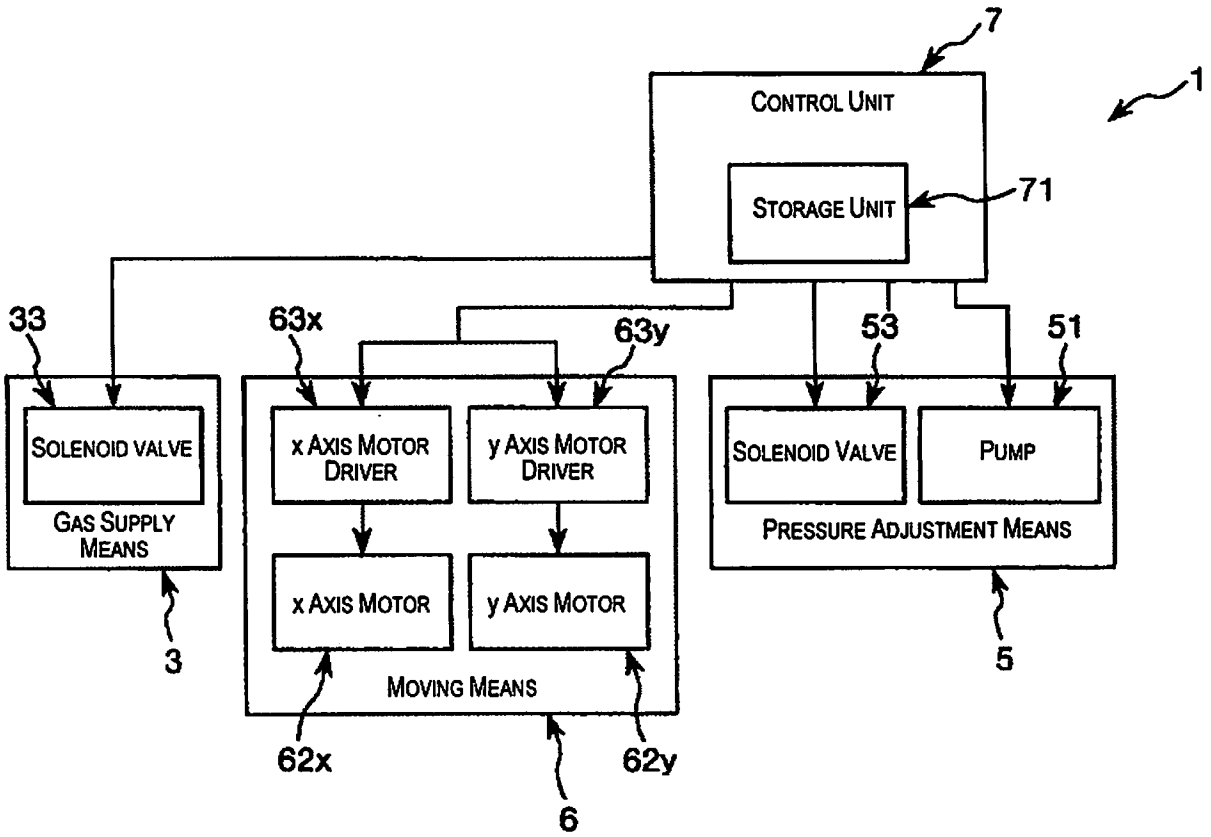
FIG. 6 is a block diagram of the key parts of the coating forming device shown in FIG. 4.

FIG. 4 is a vertical cross section side view showing a preferred embodiment of the coating forming device used to form the coating. FIG. 5 is a vertical cross section side view showing an example of the constitution of the crushing device that the coating forming device is equipped with. FIG. 6 is a block diagram of the key parts of the coating forming device shown in FIG. 4. For convenience of the description, in FIG. 4, an x axis, y axis, and z axis are shown as the three axes orthogonal to each other. The x axis is the axis along one direction among the horizontal directions, the y axis is the axis along the direction perpendicular to the x axis which is the horizontal direction, and the z axis is the axis along the vertical direction (up-down direction). Also, the tip side of each arrow in the drawing is the "positive side (+side)" and the base side is the "negative side (−side)." Also, the upper side in FIG. 4 is called "top (above)," and the lower side is called "bottom (below)." Also, in FIG. 4, an illustration of the ground layer P2 provided on the substrate P1 is omitted.

The coating forming device 1 is an "aerosol deposition device" for forming the coating P3.

The aerosol deposition device is a device by which an aerosol, made by separately prepared fine particles (fine particles of the coating material) being dispersed in gas, is sprayed from a nozzle toward the substrate, and by that impact force, the coating is formed on the substrate.

As shown in FIG. 4, FIG. 5, and FIG. 6, the coating forming device 1 is equipped with an aerosol generator 15, a crushing device 4, a film forming chamber 16, a coupling tube 2, a coupling tube 8, a gas supply means or gas supplier 3, a pressure adjustment means or pressure adjuster 5, a moving means or unit 6, and a control unit or controller 7.

The aerosol generator 15 is constituted to be able to maintain airtightness, and the particles P31 that will become the coating P3 can be housed in its interior.

The crushing device 4 is linked to the aerosol generator 15 by the coupling tube 8.

The crushing device 4 has the function of crushing the particles P31 included in the aerosol generated by the aerosol generator 15.

The film forming chamber 16 is provided independently from the aerosol generator 15 and the crushing device 4. This film forming chamber 16 is also constituted so as to be able to maintain airtightness, and can house a plurality of substrates P1 in its interior.

The chamber temperature inside the film forming chamber 16 is adjusted to 25° C. or greater and 30° C. or less for example by cooling, specifically, using a cooling medium that passes through the piping.

The coupling tube 2 links the crushing device 4 and the film forming chamber 16, and its cavity part 22 functions as a flow path through which particles P31 that become the coating P3 flow.

With the coupling tube 2, a first opening part (one end opening part) 25 open at one end of it faces the inside of the crushing device 4, and a second opening part (other end opening part) 21 open at the other end faces the inside of the film forming chamber 16.

With this kind of constitution, the aerosol generator 15 and the film forming chamber 16 are in communication via the coupling tube 8, the crushing device 4, and the coupling tube 2.

Also, the second opening part 21 is arranged in parallel in relation to the surface direction of the substrate P1 housed in the film forming chamber 16. Then, the particles P31 that pass through the coupling tube 2 (cavity part 22), and those particles are sprayed from the second opening part 21 onto the substrate P1. By doing this, the coating P3 is formed on the substrate P1 (specifically, with this embodiment, the surface of the ground layer P2). In this way, with the coupling tube 2, the second opening part 21 side part functions as a nozzle part 24.

The average inner diameter of the coupling tube 2 is not particularly limited, but for example is preferably 1 mm or greater and 10 mm or less. Also, the inner diameter of the second opening part 21 is not particularly limited, but for example is preferably 0.1 mm or greater and 1 mm or less.

Also, as the constitutional material of the coupling tube 2, though not particularly limited, it is possible to use a metal material such as stainless steel or the like, for example.

It is also preferable to provide a heating mechanism 90 that heats the coupling tube 2 on the outer circumference part of the coupling tube 2. With this heating mechanism 90, it is possible to prevent adhesion of particles P31 that pass through the coupling tube 2 onto the coupling tube 2-inner circumference part (inner wall). As the heating temperature, though not particularly limited, it is preferable to be for example 100° C. or greater and 300° C. or less, and more preferably 250° C. and 300° C. or less.

As shown in FIG. 4, the gas supply means 3 supplies gas to the inside of the aerosol generator 15. As this supply volume, though not particularly limited, for example it is preferable to be 1 L/minute or greater and 90 L/minute or less.

The gas supply means 3 has a tank 31 in which the gas is filled, a coupling tube 32 that links the tank 31 and the aerosol generator 15, and a solenoid valve 33 arranged midway in the coupling tube 32.

The tank 31 can pool the gas in an airtight manner.

As the gas pooled in the tank 31, though not particularly limited, for example, it is possible to use nitrogen gas, or otherwise also possible to use an inert gas such as helium, argon or the like. Also, when using an item with particles P31 constituted using a metal oxide, it is possible to suitably use an item including oxygen as the gas. By doing this, it is possible to prevent unintentional reduction of the particles P31.

The tank 31 and the aerosol generator 15 are in communication via the coupling tube 32. This coupling tube 32 can be a rigid item or can be a flexible item.

Also, a solenoid valve 33 is arranged midway in the lengthwise direction on the coupling tube 32. The solenoid valve 33 opens and closes the coupling tube 32. Then, when the solenoid valve 33 is in an open state, the tank 31 and the aerosol generator 15 are in communication. By doing this, supplying of the gas from the tank 31 to the aerosol generator 15 is performed. Also, when the solenoid valve 33 is in the closed state, communication between the tank 31 and the aerosol generator 15 is blocked. By doing this, the supply of the gas from the tank 31 to the aerosol generator 15 is stopped.

By the gas being supplied from the tank 31 to the aerosol generator 15, the particles P31 housed in the aerosol generator 15 are dispersed in gas and aerosol is generated. The aerosol generated inside the aerosol generator 15 in this way is introduced inside the crushing device 4 via the coupling tube 8 by the gas from the tank 31 functioning as a carrier gas.

As shown in FIG. 5, the crushing device 4 is equipped with a container 41 in which aerosol containing particles P31 is introduced, an aerosol introduction port 42 in which aerosol including particles P31 is introduced from the coupling tube 8, a crushing tool 43 for performing crushing of the particles P31, an aerosol lead-out port 44 for leading out the aerosol including the crushed particles P31 to the coupling tube 2, a brush 45 for removing particles P31 when they have adhered to the crushing tool 43, gas introduction ports 46*a* and 46*b* for introducing gas to the inside of the container 31, and an ultrasonic vibration device 47.

With the crushing device 4, the aerosol introduction port 42 is arranged inside the container 41, and at its tip is arranged the cylindrical crushing tool 43 in state by which it can be axially rotated by a motor (not illustrated). The opening of the aerosol introduction port 42 is a slit for which the cylinder axis direction of the crushing tool 43 is the long side. The width of that slit is not particularly limited, but is preferably 1 mm or less.

As the crushing tool 43, it is preferable to use an item for which the cylinder side surface impacted by the aerosol is constituted with a material with a high level of hardness such as titanium carbide or the like.

Above the crushing tool 43, the aerosol lead-out port 44 is arranged. Also, the brush 45 is arranged so as to contact the crushing tool 43. The gas introduction ports 46*a* and 46*b* are arranged in the space from the crushing tool 43 to the aerosol lead-out port 44, and the ultrasonic vibration device 47 is arranged at the outer circumference part of the aerosol lead-out port 44.

The aerosol generated with the aerosol generator 15 is accelerated by the aerosol introduction port 42, and is made to collide with the cylinder side surface of the crushing tool 43. The bold arrow in the drawing shows the advancing direction of the aerosol. The crushing tool 43 rotates in the clockwise direction as shown by the arrow in the drawing. Therefore, the aerosol for which the introduced position gradually changes impacts the cylinder side surface of the aerosol crushing tool 43 while always changing the impact surface. By doing this, even when the aerosol generated with the aerosol generator 15 contains a relatively large amount of agglomerated particles, it is possible to efficiently crush those agglomerated particles.

There are cases when a small amount of particles P31 in the aerosol adhere to the cylinder side surface, but the adhered powder is brushed off using the brush 45, and accumulated at the bottom of the container 41. The agglomerated particles impact the crushing tool 43 and are crushed, and are converted to aerosol rich with primary particles. The aerosol introduced from the aerosol introduction port 42 collides diagonally with the cylinder side surface of the crushing tool 43, so though the majority of the aerosol is reflected along the tangent line of the cylinder side surface, since there is a certain degree of spreading width, it is possible to have it impact and adhere to the inner wall of the aerosol lead-out port 44, but to prevent this, it is suitable to devise this so that gas is introduced from the gas introduction ports 46*a* and 46*b*, a curtain-like gas film is formed on the inner surface of the aerosol lead-out port 44 to prevent adhering, the ultrasonic vibration device 47 is operated to vibrate the aerosol lead-out port 44, and adhesion does not progress. The small arrows from the gas introduction ports 46*a* and 46*b* show the flow of gas introduced from here. Furthermore, by ionizing the introduced gas in advance, it is preferable to neutralize the surface charge and prevent re-agglomeration in the aerosol.

The aerosol converted to an aerosol rich with primary particles and lead out in this way is lead to a nozzle (not illustrated), and therefore it is possible to form a structure without trouble and with few defects over the long term.

The aerosol converted to the item rich in primary particles with the crushing device 4 is introduced to the coupling tube 2, and is sprayed from the second opening part 21 onto the substrate P1. Then, the particles P31 are impacted and adhered to the substrate P1, and as a result, the coating P3 is formed.

The pressure adjustment means 5 is an item that makes the pressure inside the film forming chamber 16 lower than the pressure inside the aerosol generator 15 and the pressure inside the crushing device 4.

As shown in FIG. 4, the pressure adjustment means 5 has a pump 51 that suctions the inside of the film forming chamber 16, a coupling tube 52 that links the pump 51 and the film forming chamber 16, and a solenoid valve 53 that is arranged midway in the coupling tube 52.

The pump 51 is an item that suctions the gas $G_2$ inside the film forming chamber 16. By this suction, the gas $G_2$ inside the film forming chamber 16 is exhausted via the coupling tube 52, and thus, the pressure inside the film forming chamber 16 is reliably lower than the pressure inside the aerosol generator 15 and the pressure inside the crushing device 4. By doing this, it is possible to reliably flow the particles P31 inside the film forming chamber 16, and thus possible to reliably form the coating P3.

The pressure inside the film forming chamber 16, though it depends on the pressure inside the aerosol generator 15 and the like, can be, for example, less than 10 kPa when the pressure inside the aerosol generator 15 is 10 kPa or greater and 1 MPa or less.

Also, as the pump 51, though this is not particularly limited, for example, it is possible to use a turbo-molecular pump, a dry pump, a mechanical booster pump, a rotary pump or the like.

The pump 51 is linked to the film forming chamber 16 via the coupling tube 52. This coupling tube 52 can be a rigid item or a flexible item.

Also, the solenoid valve 53 is arranged midway in the lengthwise direction on the coupling tube 52. The solenoid valve 53 opens and closes the coupling tube 52. Also, when the solenoid valve 53 is in an open state, by the suction force of the pump 51, it is possible to suction the inside of the film forming chamber 16, and thus, possible to reduce the pressure inside the film forming chamber 16. Also, when the solenoid valve 53 is in a closed state, the suction force of the pump 51 is blocked from acting inside the film forming chamber 16.

As shown in FIG. 4, the moving means 6 moves the substrate P1 in relation to the second opening part 21 facing the y axis direction. As shown in FIG. 4 and FIG. 6, the moving means 6 has a stage (table) 61 for conveying a plurality of substrates P1, a y axis motor 62*y* for moving the stage 61 facing the y axis direction, and a y axis motor driver 63*y* for controlling the driving of the y axis motor 62*y*. Also, the moving means 6 has an x axis motor 62*x* that can move the stage 61 in the x axis direction and perform that movement, and an x axis motor driver 63*x* that controls the driving of the x axis motor 62*x*.

The stage 61 is a member that forms a plate form constituted by a metal material such as stainless steel or the like, for example. This stage 61 is supported horizontally.

The y axis motor 62*y* is for example a servo motor, and is linked to the stage 61 via a ball screw (not illustrated) or the like. Then, by the y axis motor 62*y* rotating, the rotation force is transmitted to the stage 61 via the ball screw. By doing this, it is possible to move the plurality of substrates P1 placed on the stage 61 in the y axis direction for each stage 61.

Also, the y axis motor 62*y* is electrically connected to the y axis motor driver 63*y*.

By the control of this y axis motor driver 63*y*, it is possible to change the rotation count of the y axis motor 62*y*. By doing this, the speed when moving the stage 61, specifically, the speed during operation of the moving means 6 becomes variable. Then, it is possible to respectively adjust the thickness of the coating P3 that is formed according to the size of that speed. For example, when the speed is "high," a "thin" coating P3 is formed, and when the speed is "low," a "thick" coating P3 is formed.

The x axis motor 62*x*, the same as with the y axis motor 62*y*, is for example a servo motor, and is linked to the stage 61 via a ball screw (not illustrated) or the like. Then, by the x axis motor 62*x* rotating, the rotation force is transmitted to the stage 61 via the ball screw. By doing this, it is possible to move the plurality of substrates P1 placed on the stage 61 in the x axis direction for each stage 61.

Also, the x axis motor 62*x* is electrically connected to the x axis motor driver 63*x*.

The control unit 7 respectively controls each operation of the gas supply means 3, the pressure adjustment means 5, the moving means 6 and the like. The control unit 7 is a personal computer (PC) with a built in CPU (Central Processing Unit), for example.

As shown in FIG. 6, the control unit 7 is electrically connected respectively to the solenoid valve 33 of the gas supply means 3, the pump 51 and the solenoid valve 53 of the pressure adjustment means 5, and the x axis motor driver 63*x* and the y axis motor driver 63*y* of the moving means 6. Then, the control unit 7 can respectively operate these individually. A control program is stored in advance a storage unit (recording media) 71 built into the control unit 7.

The storage unit 71 is constituted by, for example, magnetic or optical recording media such as a RAM (Random Access Memory: including volatile and nonvolatile), FD (Floppy Disk (Floppy is a registered trademark)), HD (Hard Disk), CD-ROM (Compact Disk Read-Only Memory) or the like, or semiconductor memory.

Next, we will give a detailed description of the operation of the coating forming device 1 with the coating forming step.

As shown in FIG. 4, with the coating forming step, alignment of the stage 61 to the second opening part 21 of the coupling tube 2 is performed so as to have the second opening part 21 of the coupling tube 2 face the substrate P1. This alignment is performed using a CCD (Charge Coupled Device) camera, based on an image taken using that CCD camera.

Also, at this time, with the coating forming device 1, the pressure adjustment means 5 operates. By doing this, the pressure inside the film forming chamber 16 is lower than the pressure inside the aerosol generator 15. This state is maintained until the formation of the coating P3 on the substrate P1 is completed.

Furthermore, with the coating forming device 1, the gas supply means 3 also operates.

Then, the moving means 6 is made to operate, specifically, the stage 61 is moved in the y axis positive direction.

As described above, by the gas supply means 3, the pressure adjustment means 5, the moving means 6 and the like operating, the aerosol containing particles P31 generated inside the aerosol generator 15 reliably passes through the coupling tube 2 toward the film forming chamber 16. The particles P31 can be smoothly passed through the coupling tube 2 by a carrier gas. After that, the particles P31 are exhausted from the second opening part 21, and sprayed in sequence on each substrate P1 and adhered. By doing this, it is possible to rapidly form the coating P3 having the desired shape on the desired sites of the substrate P1.

With the manufacturing method of the watch external part of the present invention like that described previously, it is possible to efficiently manufacture the watch external part with excellent aesthetic appearance with a method that has little waste of materials, and a small burden on the environment.

Watch

Next, we will describe the watch of the present invention.

The watch of the present invention has the watch external part of the present invention like that described above.

By doing this, it is possible to provide a watch equipped with watch external part with little waste of materials during manufacturing, and a small burden on the environment.

It is also possible to have excellent aesthetic appearance for the overall watch as well, and to have little waste of materials during manufacturing, and a small burden on the environment.

The watch of the present invention is acceptable as long as it is equipped with the watch external part of the present invention as at least one of the watch external part, and as other parts, it is possible to use publicly known items, but hereafter, we'll describe an example of the constitution of the watch of the present invention.

Figure 7:
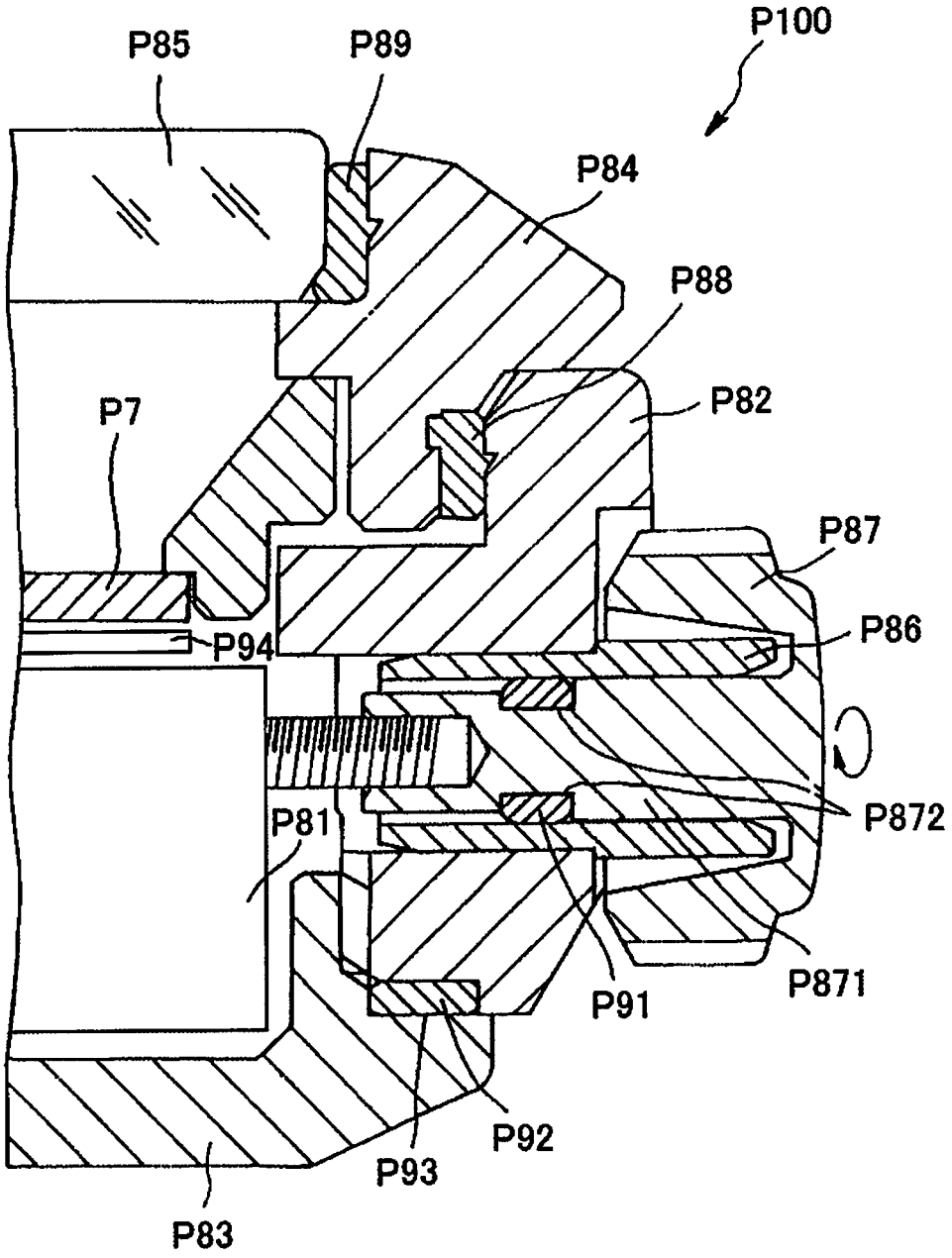
FIG. 7 is a partial cross section diagram showing a preferred embodiment of the watch (portable timepiece) of the present invention.

FIG. 7 is a partial cross section diagram showing a preferred embodiment of the watch (wristwatch) of the present invention.

As shown in FIG. 7, the wristwatch (portable timepiece) P100 of this embodiment is equipped with a barrel (case) P82, a back cover P83, a bezel (edge) P84, and a glass plate (cover glass) P85. Also, inside the case P82 are housed a timepiece dial P7, a solar battery P94, and a movement P81, and furthermore, hands (indicator needles) (not illustrated) and the like are housed.

The glass plate P85 is normally constituted with a high transparency level transparent glass, sapphire or the like. By doing this, it is possible to have sufficiently excellent visibility of the timepiece dial P7, the hands, and the like, and also possible to have light of a sufficient light volume made incident on the solar battery P94.

The movement P81 uses the electromotive force of the solar battery P94 to drive the indicator needles.

Though it is omitted in FIG. 7, inside the movement P81 are equipped, for example, an electric double layer capacitor or a lithium ion secondary battery for storing the electromotive force of the solar battery P94, a quartz resonator as a time reference source, a semiconductor integrated circuit for generating a drive pulse to drive the watch based on the oscillating frequency of the quartz resonator, a step motor for driving the indicator needles every second after receiving the drive pulse, a gear train mechanism for transmitting the movement of the step motor to the indicator needles and the like.

Also, the movement P81 is equipped with an antenna for radio wave reception (not illustrated). Also, there is a function for performing time adjustment and the like using the received radio waves.

The solar battery P94 has a function of converting light energy to electrical energy. Also, the electrical energy converted using the solar battery P94 is used for driving the movement and the like.

The solar battery P94, for example, has a pin structure for which p type impurities and n type impurities are selectively introduced to a non-monocrystal silicon thin film, and furthermore, is equipped with an i type non-monocrystal silicon thin film having a low impurity concentration between a p type non-monocrystal silicon thin film and an n type non-monocrystal silicon thin film.

A winding stem pipe P86 is fit into and fixed to the barrel P82, and a shaft part P871 of a winding knob P87 is inserted so as to be able to rotate inside this winding stem pipe P86.

The barrel P82 and the bezel P84 are fixed by a plastic packing P88, and the bezel P84 and the glass plate P85 are fixed by a plastic packing P89.

Also, the back cover P83 is fit (or screwed) onto the barrel P82, and a ring shaped rubber packing (back cover packing) P92 is interposed in a compressed state in the junction part (seal part) P93 of these. Using this constitution, the seal part P93 is sealed fluid tight, and a waterproofing function is obtained.

A groove P872 is formed on the outer circumference midway on the shaft part P871 of the winding knob P87, and a ring shaped rubber packing (winding knob packing) P91 is fit inside this groove P872. The rubber packing P91 is tightly adhered to the inner circumference surface of the winding stem pipe P86, and is compressed between that inner circumference surface and the inner surface of the groove P872. With this constitution, between the winding knob P87 and the winding stem pipe P86 is sealed liquid tight, and a waterproofing function is obtained. When the winding knob P87 is rotated and operated, the rubber packing P91 rotates together with the shaft part P871, and slides in the circumferential direction while tightly adhering to the inner circumference surface of the winding stem pipe P86.

With the description noted above, as an example of the watch, we described an example of a wristwatch (portable timepiece) as a solar radio clock, but it is possible to apply the present invention in the same way to other types of timepieces such as a portable timepiece other than a wristwatch, a table clock, a wall clock or the like. Also, the present invention can be applied to any timepiece such as a solar clock other than a solar radio clock, a radio clock other than a solar radio clock or the like.

Above, we described preferred embodiments of the present invention, but the present invention is not limited to the kinds of items noted above.

For example, with the watch external part and the watch of the present invention, the constitution of each part can be substituted with any constitutional item that exhibits the same function, and any constitution can also be added.

Also, with the embodiments described previously, the focus of our description was on the case of the watch external part being equipped with, in addition to the substrate and the coating, the ground layer and the antireflective coating, but as long as the watch external part of the present invention is equipped with the substrate and the coating, it can be an item for which at least one of the ground layer and the antireflective coating is not equipped.

Also, with the manufacturing method of the watch external part of the present invention, it is also possible to perform front end processing steps, intermediate processing steps, and back end processing steps as necessary.

Also, the opening part of the coupling tube of the coating forming device faces the z axis negative direction with the first embodiment, but the invention is not limited to this, and for example, can also face the x axis positive direction, the x axis negative direction, the y axis positive direction, the y axis negative direction, or the z axis positive direction.

Also, the moving means of the coating forming device is constituted so as to move the substrate in the y axis positive direction in relation to the nozzle part of the coupling tube, but the invention is not limited to this, and for example, can also be constituted so as to move the nozzle part of the coupling tube in the y axis positive direction in relation to the substrate.

Also, the moving means of the coating forming device can also be constituted to be able to move the stage in the z axis direction. It is also possible to constitute the stage to be able to be rotated.

Also, with the coating forming device, when forming the coating on the substrate, with this embodiment, the formation was performed while moving the stage, but the invention is not limited to this, and for example, it is also possible to stop the movement of the stage and perform formation each time the nozzle is positioned on the substrate.

Also, with the embodiments described previously, we described the coating forming device as being equipped with a crushing device, but to form the coating, it is also possible to not be equipped with the crushing device.

Also, with the embodiments described previously, we described the coating forming device as being equipped with a heating mechanism that heats the coupling tube, but to form the coating, it is also possible to not be equipped with the heating mechanism.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A watch external part comprising:

a substrate made of a material including one type or two or more types selected from a group consisting of sapphire glass, quartz, and plastic;

a coating formed using an aerosol deposition method; and a ground layer having at least one layer between the substrate and the coating, the ground layer including a layer made of TiN, the coating being selectively provided at a portion of a site observable through the substrate and the ground layer in a state with the watch external part on a watch, and the coating being made of a metal material and directly disposed on the ground layer.

2. The watch external part according to claim 1, wherein the substrate is transparent.

3. The watch external part according to claim 1, further comprising an antireflective coating disposed on a surface side opposite to a surface of the coating facing the substrate.

4. A watch comprising the watch external part according to claim 1.

5. A watch external part comprising:

a substrate made of a material including one type or two or more types selected from a group consisting of sapphire glass, quartz, and plastic;

a coating formed using an aerosol deposition method; and a ground layer having at least one layer between the substrate and the coating, the ground layer includes a layer made of TiN, the coating being selectively provided at a portion of a site observable through the substrate and the ground layer in a state with the watch external part on a watch, and the coating being made of a metal oxide and/or a metal nitride and directly disposed on the ground layer.

6. A manufacturing method for a watch external part, the method comprising:

preparing a substrate;

forming a ground layer having at least one layer on the substrate after the preparing of the substrate; and forming a coating directly on the ground layer using an aerosol deposition method after the forming of the ground layer on the substrate, the coating being selectively provided at a portion of a site observable through the substrate and the ground layer in a state with the watch external part on a watch, and the coating being made of a metal material and directly disposed on the ground layer.

7. The manufacturing method for a watch external part according to claim 6, further comprising forming an antireflective coating after the forming of the coating.

8. A watch comprising the watch external part manufactured using the manufacturing method according to claim 6.

9. A watch bezel comprising:

a substrate made of a material including one type or two or more types selected from a group consisting of sapphire glass, quartz, and plastic;

a coating formed using an aerosol deposition method; and a ground layer having at least one layer between the substrate and the coating, the ground layer including a layer made of TiN, the coating being selectively provided at a portion of a site observable through the substrate and the ground layer in a state with the watch bezel on a watch, and the coating being made of a metal material and directly disposed on the ground layer.

* * * * *